United States Patent [19]

Dimier et al.

[11] Patent Number: 4,699,396

[45] Date of Patent: Oct. 13, 1987

[54] SKI SAFETY BINDING

[75] Inventors: Jean-Pierre Dimier, Rumilly; Joel Bourdeau, Saint Jorioz, both of France

[73] Assignee: Salomon S.A., Annecy, France

[21] Appl. No.: 645,109

[22] Filed: Aug. 28, 1984

[30] Foreign Application Priority Data

Dec. 20, 1983 [FR] France ..... 83 20356

[51] Int. Cl.[4] ..... A63C 9/085

[52] U.S. Cl. ..... 280/628; 280/634

[58] Field of Search ..... 280/625, 626, 628, 629, 280/634, 636

[56] References Cited

U.S. PATENT DOCUMENTS

| | | | |
|---|---|---|---|
| 4,260,175 | 4/1981 | Salomon | 280/629 |
| 4,337,965 | 7/1982 | Salomon | 277/329 |
| 4,345,776 | 8/1982 | Salomon | 280/629 |
| 4,405,153 | 9/1983 | Salomon | 280/629 |
| 4,439,011 | 1/1987 | Rullier . | |

FOREIGN PATENT DOCUMENTS

| | | |
|---|---|---|
| 0025747 | 3/1981 | European Pat. Off. . |
| 0030175 | 8/1981 | European Pat. Off. . |
| 2905837 | 2/1979 | Fed. Rep. of Germany . |
| 1363895 | 5/1961 | France . |
| 2258876 | 1/1975 | France . |
| 2248680 | 5/1975 | France . |
| 2263796 | 10/1975 | France . |
| 2419737 | 10/1979 | France . |
| 2420359 | 10/1979 | France . |
| 2458299 | 1/1981 | France . |
| 2463629 | 2/1981 | France . |
| 2478476 | 9/1981 | France . |
| 2517214 | 6/1983 | France . |
| 2523857 | 9/1983 | France . |
| 8320355 | 12/1983 | France . |

OTHER PUBLICATIONS

U.S. patent application Ser. No. 579,376, filed Feb. 13, 1984.

U.S. patent application Ser. No. 560,845, filed Dec. 13, 1983.

*Primary Examiner*—John J. Love

*Assistant Examiner*—Richard Camby

*Attorney, Agent, or Firm*—Sandler & Greenblum

[57] ABSTRACT

A binding having a jaw is adapted to pivot laterally around two converging support lines on a support against the bias of an elastic mechanism. The binding also includes two lateral wings for receiving a front end of the boot, and a support zone positioned between the wings. The support zone is adapted to contact the front end zone of the boot along a line which intersects a transverse plane passing through the support lines above their convergence point. As a result, when a torsional fall is combined with a frontward fall, the torsional component of the fall causes the boot to apply lateral pressure to one of the wings, thereby providing a torque or moment on the jaw. The frontward component of the fall causes the boot to apply frontward pressure on the support zone, thereby increasing the torque experienced by the jaw in the direction of the torque resulting from the torsional component of the fall.

58 Claims, 16 Drawing Figures

SKI SAFETY BINDING

BACKGROUND OF THE INVENTION

1. Field on the Invention

The present invention relates to an improvement to the ski binding described in U.S. application Ser. No. 579,376, filed Feb. 13, 1983, now U.S. Pat. No. 4,639,011, issued Jan. 27, 1987, and in French Patent Application No. 83 02309. In addition, the present invention relates to a ski provided with such a binding.

2. Description of Relevant Information

The U.S. and French applications referred to above relate to a safety binding or "front abutment" binding which comprises:

- a jaw adapted to receive and to retain the front end of the ski boot with respect to the ski. Two lateral wings are provided for this purpose at the front of the jaw. The wings are adapted to grip the boot on both lateral sides thereof;
- a support element defining for the jaw, two rearwardly directed lines of support with respect to the ski, for guiding the lateral pivoting of the jaw. The two lines of support converge downwardly to a point, and define a common plane transverse with respect to the ski such that lateral pivoting of the jaw with respect to the ski, around either one of the support lines is accompanied by a lifting of the wings of the jaw with respect to the ski; and
- an elastic energization mechanism which presses the jaw rearwardly against the support element and biases the jaw elastically against lateral pivoting.

In the above-mentioned U.S. and French applications and in the description of the bindings discussed below, absent specific mention to the contrary, the relative positions of the various elements of the ski binding extend in the normal direction of displacement thereof.

This known binding is adapted to retain the front end of the boot on the ski, while the rear end is retained on the ski by other means. This front abutment is adapted to free the boot in response to excessive torsional forces at the level of the leg. When such torsional forces occur, they are also applied laterally to the wings of the binding, thereby overcoming the bias of the elastic energization system so as to laterally pivot the jaw and free the boot. An appropriate calibration system is provided for the elastic energization mechanism which makes it possible to adjust the release threshold above which the boot is released.

Such a simple system responds in an entirely satisfactory fashion to a fall which induces torsional movement of the boot. In such an instance, lateral pivoting of the jaw frees the boot due to the lateral pivoting of the retention wings. In addition, lateral pivoting of the jaw can also be accompanied by a frontward movement of the jaw with respect to the support element, against the resistance of the elastic energization mechanism.

However, it has been discovered that such a binding requires an additional complementary apparatus when a torsional fall is combined with a frontward fall.

During a frontward fall, the zone of the sole which is perpendicular to the front of the foot is applied against the ski with a substantial force directed downwardly, which serves to create an appreciable frictional force between the bottom of the sole and the ski. This frictional force opposes lateral pivoting of the boot, and its liberation from the jaw.

SUMMARY OF THE INVENTION

It is a goal of the present invention to perfect the safety binding of the type discussed above such that it is adapted to release the boot during a torsional fall as well as during a torsional fall in combination with a frontward fall, without increasing cost of the binding and without damage to the leg.

The ivention which accomplishes this goal relates to ski binding adapted to releasably hold the front of a ski boot on the ski. The front of the boot comprises the front end zone at the tip of the boot and spaced from the lateral edges of the boot. The binding, which holds such a boot, comprises a jaw, a support, and a support zone means. The jaw is adapted to hold the front of the boot and is adapted to laterally pivot in response to pivoting of the boot. The support is on the ski and comprises two downwardly converging lines of support. The jaw is adapted to laterally pivot around either one of these two downwardly converging lines of support. The support zone means is positioned on the jaw and supports the front end zone of the boot when the front of the boot is held by the jaw. In addition, the invention can comprise this binding in combination with the ski.

The jaw further comprises a rear portion and two lateral wings. Each lateral wing is adapted to grip one of the lateral sides of the boot. In addition, the wings are positioned at the rear portion of the jaw.

The support zone means is also positioned at the rear portion of the jaw between the two lateral wings and can be integral with the two wings.

The binding can further include an elastic energization mechanism adapted to press the jaw rearwardly against the support. This elastic energization mechanism biases the jaw against lateral pivoting.

In one embodiment, the support comprises a rear portion on which the two downwardly lines of support are positioned. In this embodiment, the jaw and the support together comprise means for lifting the jaw when the jaw laterally pivots around to either one of the two downwardly converging lines of support.

The downwardly converging lines of support define a common transverse plane with respect to the ski. In addition, the downwardly converging lines of support converge at a convergence point. In this embodiment, the support zone further comprises a means for supporting the front end zone of the boot along the line which intersects the transverse plane between the support lines and above this convergence point.

When the binding holds the boot and is used during skiing, the jaw may experience a torque or moment in response to lateral pressure from the boot against one of the lateral wings. This can occur when the boot experiences some type of torsion which causes the boot to experience a moment, pivoting the boot laterally against one of the lateral wings. When this occurs, the support zones means increases this moment experienced by the jaw in response to forward pressure of the front end zone of the boot on the support zone means.

In one embodiment, the support zone means is positioned higher than the convergence point.

In another additional embodiment, the boot comprises a sole having a front end and a front end zone spaced from the lateral sides of the boot. In addition, each lateral wing comprises a recess adapted to receive this front end of the sole. In this embodiment, the support zone means is positioned substantially at the same vertical level as the recesses is so that the support zone means comprises means for supporting the front end zone of the sole of the boot.

In an alternative embodiment, the boot comprises an upper having a front end zone. In this alternative embodiment, the support zone means is positioned higher than the recesses so that the support zone means comprises means for frontwardly supporting the front end zone of the upper.

In addition, the jaw may further comprise the means for adjusting the relative positions of the lateral wings and the support zone means. Also, the two support lines may be positioned symmetrically with respect to one another and with respect to the longitudinal plane of symmetry of the ski. Similarly, this support zone means is symmetrical with respect to the plane of symmetry of the ski when the binding is in its rest position in which the longitudial axis of the jaw is substantially parallel to the plane of symmetry. It should be noted that the two lines of support may contact the jaw when the binding is in its rest position and that the binding is may be constructed so as to be symmetrical with respect to the plane of symmetry of the ski when the jaw is supported by both lines of support on the support simultaneously.

In one embodiment, the support zone is convex and open toward the rear of the jaw. This convex support is defined by generatrices which are substantially perpendicular to the longitudinal axis of the binding and extend above the convergence point.

In addition, a surface may be provided between the jaw and the support which has a low coefficient of friction between 0.01 and 0.25. In one embodiment, the surface may comprise the materials selected from the group consisting of polyethylene and polytetrafluorethylene. In another embodiment, the invention relates to the ski binding adapted to releasably hold the front of a boot on the ski. The front of the boot may comprise a front end zone spaced from the lateral edges of the boot. The binding comprises a jaw, adapted to hold the front of the boot and adapted to laterally pivot in response to lateral pivoting of the boot. Also provided is a support on the ski. This support comprises two downwardly converging lines of support around either of which the jaw is adapted to laterally pivot. When a boot is attached to the binding the jaw may experience a torque or moment in response to lateral pressure from the boot against the jaw. Also provided is a means for increasing this moment experienced by the jaw in response to the boot experiencing a frontward force. In this way, when a torsional fall which pivots the boot laterally, is combined with a forward fall, the increased friction of the boot against the ski which is caused by such a fall is compensated for by the increased torque or moment experienced by the jaw during this fall. Therefore, the means which increases the torque experienced by the jaw increases this moment in response to a frontward fall experienced by the boot. This embodiment of the binding, which uses this means for increasing the torque or moment, includes all of the limitations recited above with respect to the other embodiments.

In addition to the support zone and the means for increasing the moment in the above embodiment, the binding also comprises an elastic means for biasing the jaw and support into contact with each other. The elastic means biases the jaw against the support. In one embodiment the support comprises a portion comprising the lines of support, and the elastic means continuously maintains the portion of the jaw in contact with this portion of the support and at least one of the lines of support. In addition, the jaw is adapted to be positioned in a rest position in which the longitudinal axis of the jaw is substantially parallel to the longitudinal axis of the ski. The elastic means is adapted to maintain the jaw in contact with both lines of support on the support when the jaw is in the rest position.

In each of the embodiments discussed above, the jaw may have a cavity therein adapted to receive the support. In addition, the jaw further comprises anterior and posterior portions on opposite sides of the cavity. The jaw also comprises a means for holding the boot, which is positioned on the posterior portion of the jaw. The anterior portion of the jaw comprises a surface which the elastic means biases against the anterior portion of the support.

In one embodiment, the anterior portion of the support comprises first and second projections positioned symmetrically with respect to the vertical and longitudinal plane of symmetry of the binding. The anterior portion of the support also comprises a third projection, spaced below the first and second projections and positioned in the vertical and longitudinal plane of symmetry of the binding. In addition, in this embodiment, the surface on the anterior portion of the jaw comprises first and second grooves, adapted to engage the first and second projections, respectively, and a third groove adapted to engage the third projection. These projections comprise the two lines of support. More specifically, the first and third projection comprise one of the lines of support around which the jaw pivots, and the second and third groove and the second and third projection comprise the other line of support around which the jaw laterally pivots. In addition, the first and second projections are laterally spaced apart and are at substantially the same vertical height. Also, the projections on the support are in substantially the same transverse plane.

In an alternative embodiment, the anterior portion of the support comprises first and second grooves, positioned symmetrically with respect to the longitudinal and vertical plane of symmetry of the binding, and a third groove, spaced below the first and second grooves. The third groove is positioned in the vertical and longitudinal plane of symmetry of the binding. In this embodiment, the surface on the anterior portion of the jaw comprises first and second projections, adapted to engage the first and second grooves, respectively, and a third projection, adapted to engage the third groove. These grooves comprise the two lines of support. More specifically, the first and third groove comprise one of the lines of support, and the second and third groove comprise the other line of support.

In an alternative embodiment, the anterior portion of the support comprises two elements, having a V-shaped configuration. These two elements are positioned symmetrically with respect to the longitudinal and vertical plane of symmetry of the binding. In addition, in this embodiment, the surface on the anterior portion of the jaw comprises two complementary elements, also having a V-shaped configuration. These complementary elements are adapted to engage the two elements on the anterior portion of the support. The two V-shaped elements on the support comprise the two lines of support. In one embodiment, the two elements on the support are projections and the two elements on the jaw are grooves. Alternatively, the two elements on the support may be grooves and the two elements on the jaw may comprise projections.

The jaw may also comprise an anterior portion having an axial bore therein which houses the elastic means, in the form of a compression spring. In this embodiment, the jaw may further comprise a wall having first and second sides, the first side of which comprises one end of the axial bore, and the second side of which is adjacent to an anterior portion of the support. In this embodiment, the compression spring contacts the first side ofthe wall. As a result of pressure of the spring against the first side of ths wall, the second side of the wall is biased against the anterior portion of the support.

The anterior portion of the jaw may further comprise a cap at the opposite end of the bore from the wall. One end of the spring contacts the wall and the other end of the spring contacts the cap. The cap may comprise means for adjusting the tension in the spring. This is accomplished by providing threads on the cap, and further providing a shaft positioned in the axial bore and having a threaded end adapted to receive the threaded cap thereon. By rotating the threaded cap on the end of the threaded shaft, the longitudinal position of the cap may be changed, thereby increasing or decreasing the "stiffness" of the spring.

The support may further comprise a posterior portion and an opening therein, extending from this posterior to the anterior portion of the support. In addition, the shaft further comprises an expanded head at the end of the shaft opposite from threaded end. This expanded head is adapted to engage the opening in the support. This opening is formed axially and horizontally in the support element. In addition, the end of this opening which is adjacent to the anterior portion is substantially hemispherical in shape, as is the expanded head. As a result of the substantially hemispherical shape of the expanded head and the opening, these elements together comprise means for permitting the shaft to follow the vertical and lateral movement of the jaw.

In addition, a portion of the opening adjacent to the anterior surface of the support is substantially bean-shaped. This portion of the opening has two downwardly inclined lateral arms.

BRIEF DESCRIPTION OF THE DRAWINGS

The invention will now be described with reference to the annexed drawings, with reference to various non-limiting embodiments in which.

DESCRIPTION OF PREFERRED EMBODIMENTS

Figure 1:
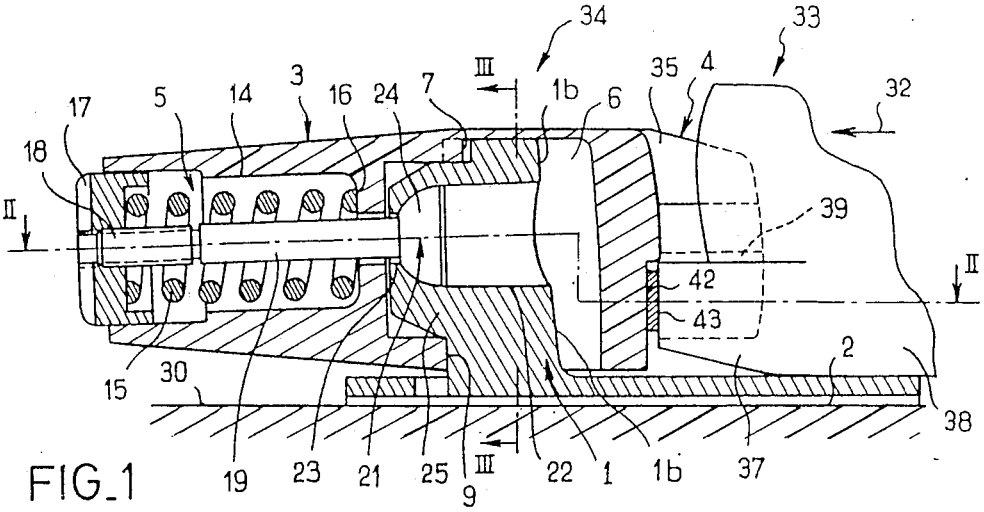
FIG. 1 is a vertical and axial cross sectional view of a first embodiment of a safety binding for a ski according to the present invention, in which the binding and the boot are at rest and are in a rest position, i.e., there is no torsional bias or any frontward force exerted on the boot or binding so that the longitudinal axis of the boot and binding are substantially parallel to the longitudinal axis of the ski. This cross sectional view is taken along plane I—I of FIG. 2, which defines for the ski and for the binding, when it is at rest, a longitudinal plane of symmetry.

It is an object of the present invention to perfect the bindings previously discussed such that when a torsional fall is accompanied by a frontward fall, a transformation of forces occurs whereby the boot presses frontwardly against the jaw to produce a lateral pivoting moment or torque which is added to the pre-existing lateral pivoting movement due to the torsional forces on the leg. As a result, the boot presses against one of the lateral wings of the jaw.

To this end, the binding according to the present invention, which is of the type discussed above, comprises a support zone integral with and positioned between two wings of the jaw. The support zone acts as a frontward support for the frontward end zone of the boot with respect to the ski, along a force line which passes between the two support lines and intersects a plane passing through both support lines, above their convergence point, such that, when the boot applies a pivoting moment or torque to one of the wings of the jaw around one of the two support lines, an additional pivoting moment is added by the boot to the jaw, as a result of the pressing of the boot frontwardly against the said support zone.

It will be seen that a binding according to the present invention can be implemented in an extremely simple and reliable manner, using a smaller number of elements, compared to the device disclosed in the above-referenced U.S. and French applications. The only essential additional element that must be provided to implement the invention is the support zone. The addition of this element causes no additional complications, practically no additional cost, and no additional risk of damage to the leg.

The present invention further provides such a binding in combination with a ski.

Referring to FIGS. 1–13, the ski is generally designated by 2. Ski 2 has, in its normal utilization position, an upper surface 30 which is generally planar and which will be taken to be horizontal in the description which follows. Ski 2 also has a longitudinal plane of symmetry 31 which will be taken as being vertical to the horizontal plane. Plane of symmetry 31 corresponds to the plane of cross section I—I in FIG. 2. Arrow 32 illustrates a reference direction, corresponding to the normal direction of displacement of the ski, which is parallel to surface 30 and situated along plane 31. This direction will serve as a reference direction when the terms "frontwardly", "rearward", "front" and "rear" appear in the description which follows, and plane 31 will serve as a reference when the term "lateral" is used.

Upper surface 30 of ski 2 has a rear binding mounted thereon (not shown) which is adapted to immobilize the rear end of the sole of a ski boot with respect to the ski which is schematically shown at 33. Also provided is a front binding mounted on surface 30 which is positioned in front of the rear binding and which comprises to the present invention. Boot 33 comprises a front end held by the binding, and a front end zone spaced from the lateral sides of the boot. The front end zone of the boot refers to either a front end zone of the upper or a front end zone 37 of the sole.

In this first embodiment shown in FIGS. 1–13, the ski safety binding according to the present invention comprises a support element 1 which is attached to upper surface 30 of ski 2 by means of screws, or by other means. A body 3, having at its rear portion a jaw 4 adapted to maintain the front end of a ski boot 33, is laterally pivotably mounted on support element 1. Pivoting body 3 is maintained in a rest position, on support element 1, by an elastic energization mechanism 5 against which the lateral safety release occurs. In the rest position, the longitudinal axis of body 3 is substantially parallel to the longitudinal axis of ski 2 and to plane 31.

Jaw 4 comprises two retention wings 35 and 36, which are symmetrical to one another and with respect to plane 31. When the binding is at rest and in its rest position, and wings 35 and 36 form a rearward projection of body 3. Wings 35 and 36 can be formed in a single rigid element with body 3 or on they can be attached to body 3 by means allowing for adjustment of the wings' position with respect to body 3 and a relative immobilization when the binding is in use.

Figure 15:
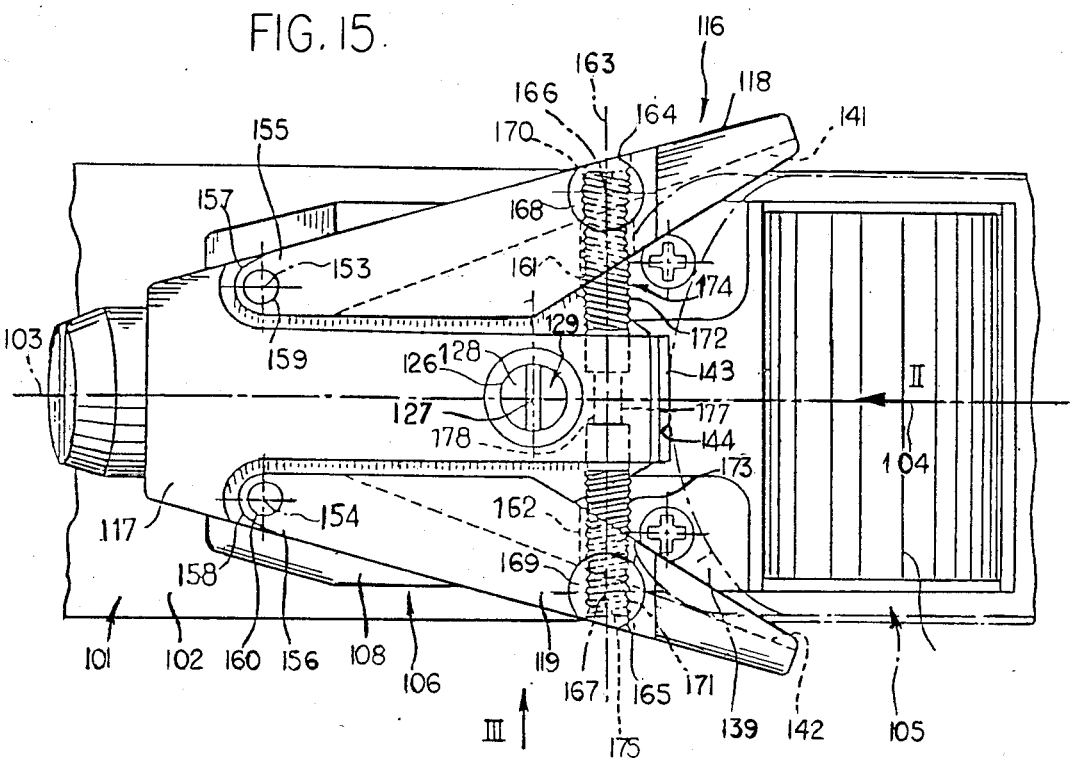
Figure 16:
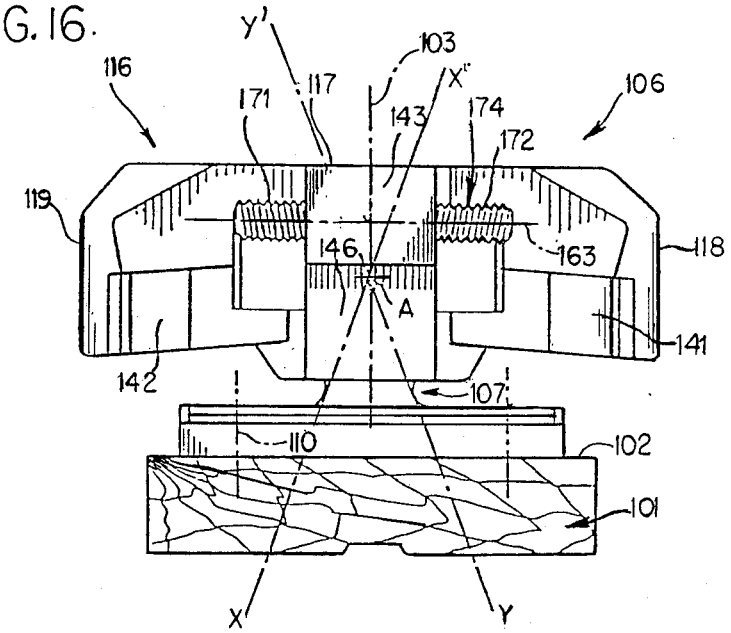

A more detailed view of this adjusting means is illustrated in FIGS. 15 and 16.

In FIGS. 15 and 16 the ski is designated by reference numeral 101 having an upper surface 102 and a longitudinal plane of symmetry 103.

Upper surface 102 on ski 101 has a rear binding mounted thereon (not shown) which is adapted to immobilize the rear end of the sole of boot 105 with respect to the ski. Front bindings 106 which is shown, is adapted to immobilize to the front portion of boot 5 and the sole of boot 5. Binding 106 is mounted on ski 101 by support 107.

Support element 107 is preferably a monoblock formed, for example, by the molding of a metal alloy with a metal base plate 108. Base plate 108 is attached to ski 101, preferably by screws schematically illustrated by axes 109 and 110.

Support 107 is adapted to be capped, by a jaw 116. Jaw 116 is also preferably a monoblock which is formed by the molding of a metal allow or by the molding of a plastic material. Jaw 16 comprises a body 117 and two lateral wings 118 and 119 supported by body 117. The assembly formed by body 117 and wings 118 and 119 functions as one integral unit during the operation of the binding, and permits the adjustment of these elements with respect to each other as will be discussed below.

Body 117 is in the form of an oblong block, which is oblong in direction 104 and is symmetrical with respect to plane of symmetry 103 when the binding is in its rest position. A top wall of body of body 117 includes an opening 126 therein, through which axis 127 passes. The binding further comprises a screw 129 having a head 128.

FIGS. 15 and 16 illustrates means for adjusting the position of lateral wings 118 and 119 with respect to each other and with respect to support zone 143 so as to more precisely adapt the binding to the exact configuration and dimension of different boots having front-end zones 144 and 139 of different shapes and sizes.

This adjustment means comprises journal axes 153 and 154, around which jaws 118 and 119 are adapted to respectively rotate. Axes 153 and 154 are positioned substantially parallel to axis 127, and are symmetrical with respect to one another and with respect to plane 103 when the binding is at rest. Also, axes 153 and 154 are positioned on either lateral side of body 117 and of the front-end zone thereof, as seen in FIG. 15.

This adjustment means also comprises a front portion of each lateral wing. More specifically, the front end of lateral wings 118 and 119 respectively, are in the form of caps 155 and 156. Caps 155 and 156 comprise two spaced apart elements, between which cramps 157 and 158, are positioned respectively. Wings 118 and 119 also respectively comprise pins 159 and 160 for connecting caps 155 and 156 with cramps 157 and 158 respectively. Furthermore, pins 159 and 160 are journal pins through which journal axes 153 and 154 pass, respectively. As a result, wings 118 and 119 pivot around pins 159 and 160 respectively.

In addition, the adjustment apparatus further comprises two openings in the rear portion of each wing 118 and 119. An alignment axis 163 passes through these two openings in wing 118 and 119. Alignment axis 163 is: substantially perpendicular to plane 103; positioned above shoulders 141 and 142; positioned above cut-out recess 146; and is positioned immediately in front of surface 145. The first of these openings are openings 161 and 162, which are positioned respectively, in the interior of lateral wings 118 and 119. The second openings are openings 164 and 165 which are also positioned respectively in lateral wings 118 and 119. Openings 164 and 165 are positioned between openings 161 and 162, respectively, and the exterior of lateral wings 118 and 119, respectively. Openings 164 and 165 comprise a cylinder of revolution around axes 166 and 167, respectively. Axes 166 nd 167 are substantially perpendicular to alignment axis 163 and substantially parallel to axes 153 and 154. Axes 166 and 167 are also symmetrical with respect to one another and with respect to plane 103 when the binding is in its rest position.

Each of second openings 164 and 165 are adapted to receive journals 168 and 169, respectively, therein. Journals 168 and 169 are adapted to rotate around axes 166 and 167, respectively, within openings 164 and 165, respectively. In addition, openings 164 and 165 are adapted to guide the rotation of journals 168 and 169 therein, respectively. Journals 168 and 169 comprise tapped bores 170 and 171, respectively. Alignment axis 163 is the longitudinal axis of bores 170 and 171 and the longitudinal axes of these bores 170 and 171 is also the longitudinal axes of openings 161 and 162.

Each tapped bore 170 and 171 has inverse threads as may be seen in FIGS. 15 and 16. Tapped bore 170 and 171 are adapted to receive an end zone 172 and 173, respectively, of a pin 174. End zones 172 and 173 of pin are threaded in a complimentary manner to bores 170 and 171 so that each end zone 172 and 173 of pin 174 can be screwed in bores 170 and 171, respectively. When this is done, the longitudinal axis of pin 174 coincides with axis 163. In addition, pin 174 has, at one of its ends, a slot 175 which is adapted to receive a screwdriver. In the embodiment seen in FIG. 15, slot 175 is positioned within journal 169 of wing 119.

As can be seen in FIG. 15, pin 174 is adapted to extend from wing 118, through body 117 to wing 119. As a result, body 117 must comprise an opening to accommodate pin 174. This opening is a slit 176, which traverses body 117 on both sides thereof along axis 163. Furthermore, a central plane which passes through the center of slit 176 includes axis 163 and is substantially perpendicular to axes 153 and 154. In addition, slit 176 opens toward surface 145 where it is closed by support 143 to allow engagement of pin 174 for the assembly of the apparatus.

Pin 174 also comprises a peripheral groove 177, positioned at substantially its midlength, in the zone situated within slot 166. Groove 177 is adapted to engage a recess 178 provided in slot 176 at the intersection of groove 177 with plane 103. Furthermore, recess 178 extends symmetrically on both sides of plane 103.

The binding assures the immobilization of pin 174 vis-a-vis body 117 along axis 163 by virtue of the engagement of pin 174 with tapped bores 170 and 171. In addition, the free displacement of pin 174 in the rearward direction through slot 76 is also impossible by virtue of the engagement of pin 174 with journals 168 and 169. However, a slight displacement of pin 174 in slot 176 is possible along the median plane thereof in the forward or rearward direction. Furthermore, pin 174 can be rotated around axis 163 as well with respect to journals 169 and 170. This can be accomplished by introducing a screwdriver into slot 175 to rotate pin 174. The rotation of pin 174 causes lateral wings 118 and 119 to move toward or away from each other, depending upon whether the user rotates the screwdriver in slot 175 in one direction or the other. As a result, the relative positions of shoulder 141 and 142 on the front-end zone 139 of sole 140 and the relative position of shoulders with respect to support 143 and front-end zone 144 of the upper of the boot can be changed while preserving the symmetrical position of wings 118 and 119 with respect to plane 103.

Of course, it is also within the scope of the invention to provide means for preventing spontaneous rotation of pin 174. For example, one can select an appropriate pitch of the threading of pin 174 and of the tapping of the journal 168 and 169 while taking into account the material of which each of these elements is composed, so as to prevent the spontaneous rotation of pin 174. In addition, any other means known to those skilled in the art can be used for this purpose.

Each of wings 35 and 36 is adapted to laterally retain, on one respective side of plane 31, a portion of front end 37 of sole 38 of boot 33 at the lateral sides of the boot. A receiving recess 39 or 40, which opens downwardly, to the rear and toward plane 31 is provided for this purpose.

In case of torsional bias at the level of the leg of the skier, a portion of the front end 37 of sole 38 is applied either against wing 35 or wing 36. End 37 applies a force against wings 35 or 36 in the direction away from plane 31 which causes a lateral pivoting of the body assembly 3 and of jaw 4 with respect to support element 1 against the bias of elastic mechanism 5, as will be explained below.

The assembly formed by pivoting body 3 and jaw 4 has a cavity 6 in front of the jaw which opens onto the lower surface of body 3 and in which support element 1 is engaged. Thus, body 3 acts as a cap, to some extent, for element 1.

Figure 4:
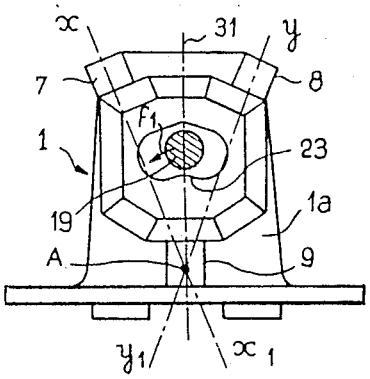
FIG. 4 is an elevational view of the support element taken from the left of FIG. 1, i.e., from front to rear with reference to this direction.
Figure 5:
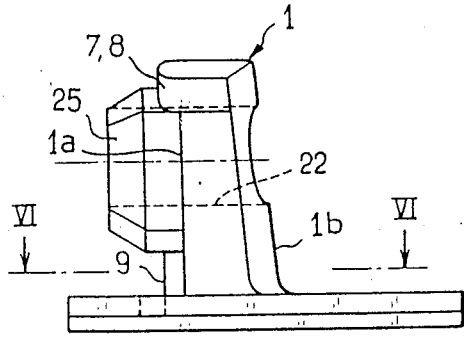
FIG. 5 is a profile view of the support element.
Figure 7:
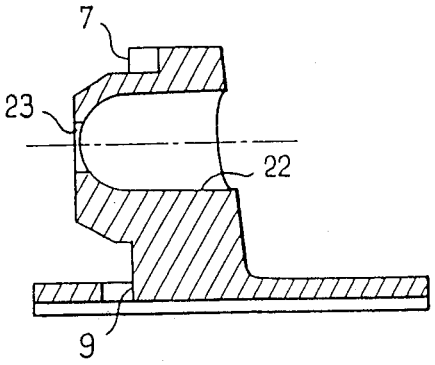
FIG. 7 is a view of the support element in vertical cross section along plane VII—VII of FIG. 6.
Figure 6:
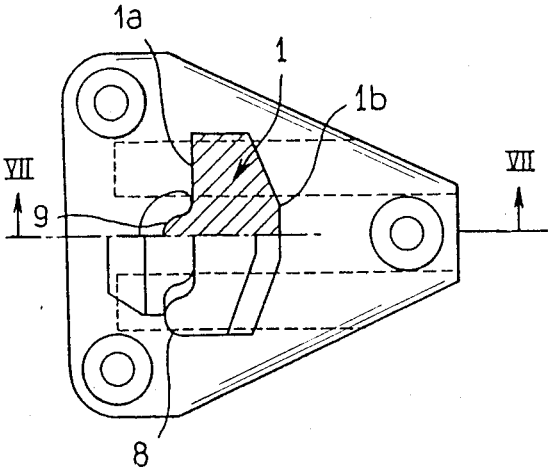
FIG. 6 is a view of the support element, half of which is horizontal cross sectional along plane VI—VI of FIG. 5 and half of which is a planar view.
Figure 8:
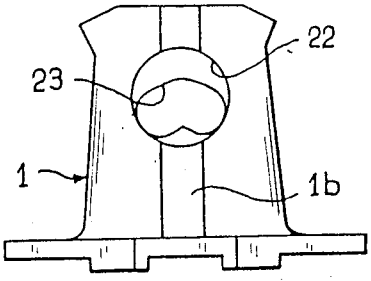
FIG. 8 is an elevational view of the support element taken from the right of FIG. 1, i.e., from the rear to the front with reference to the normal direction of displacement of the ski.

Pivoting body 3 is applied under pressure under the action of elastic energization mechanism 5, against a front or anterior surface 1*a* of support element 1. Body 3 is pressed against support element 1 along two lines of support $xx_1$ and $yy_1$ which converge downwardly in the direction of the ski, as can be seen in FIG. 4. In one non-limiting embodiment, the two lateral support lines $xx_1$ and $yy_1$ are formed by two upper projections 7 and 8 provided on front surface 1*a* of support element 1 symmetrically with respect to the vertical and longitudinal plane of symmetry 31 of the binding. Projection 7 is positioned on the same side of plane 31 as wing 35, and projection 8 is positioned on the same side of plane 31 as wing 36. The two support lines also comprise a single lower projection 9 positioned in plane 31. Support line $xx_1$ is defined by projections 7 and 9 while the other support line $yy_1$ is defined by projections 8 and 9. As a result, these two lines of support converge symmetrically toward one another with respect to plane 31 at a point A on lower projection 9 and define a common plane 41 which includes projections 7–9 and which is substantially perpendicular to plane 31 and at least generally or substantially perpendicular to direction 32. The three projections 7, 8 and 9 are preferably molded integrally with the rest of support element 1 and they are positioned in substantially the same transverse plane.

Figure 9:
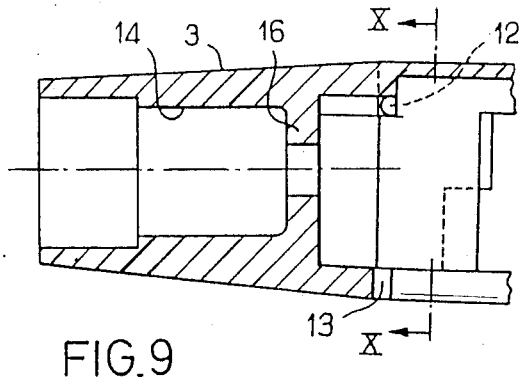
FIG. 9 is a partial cross sectional view, along plane I—I in FIG. 2 of the pivoting body which comprises the jaw.
Figure 10:
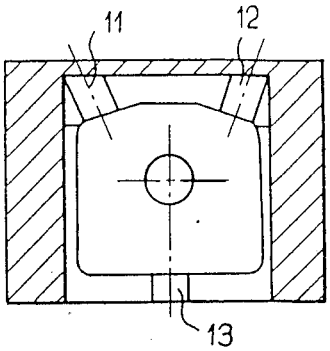
FIG. 10 is a transverse cross sectional view along plane X—X of FIG. 9.
Figure 11:
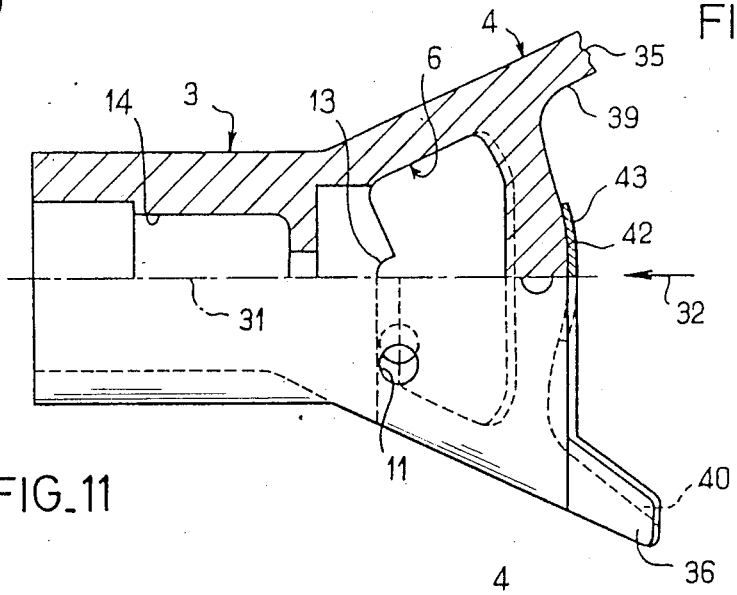
FIG. 11 is a view which is half in horizontal cross section along planes II—II of FIG. 1.
Figure 12:
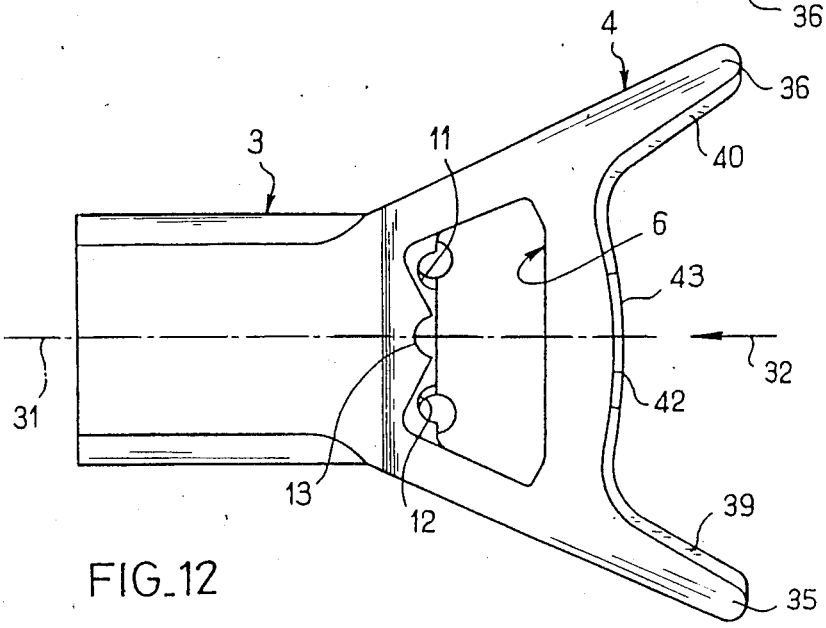
FIG. 12 is a bottom view of the pivoting body assembly.

As seen in FIGS. 9–11, body 3 comprises three depressions 11, 12, and 13, which are adapted to be pressed against support element 1. Depressions 11, 12 and 13 are positioned on a front or anterior surface which defines the front end of cavity 6. Depressions 11 and 12 comprise upper depressions positioned above lower central depression 13. Upper depressions 11 and 12 are adapted to engage upper projections 7 and 8 while a lower central depression 13 is adapted to engage lower projection 9.

The pressing of pivoting body 3 on the front surface 1*a* of support element 1 can be accomplished by any appropriate means, for example, by one of the energization mechanisms described in U.S. application Ser. No. 574,376 or French Patent No. 83 02309, the disclosures of which are hereby incorporated by reference.

In a non-limiting embodiment shown in FIGS. 1–13, elastic energization mechanism 5 is positioned within an axial bore 14 provided in the front portion of body 3. Mechanism 5 extends frontwardly along an axis included in plane 31 and generally horizontal when the binding is in its rest position. Mechanism 5 comprises a compression spring 15 which is supported, on one end, by transverse end wall 16 of bore 14, positioned near support element 1, and on the other end by a cap 17 blocking the exterior orifice of bore 14. Cap 17 is screwed on threaded end 18 of an axial shaft 19, comprising a retention bott. Bolt 19 comprises, at its rear end, an expanded head 21 which is adapted to engage a housing 22 formed longitudinally and horizontally in support element 1. Housing 22 opens onto a rear surface 1*b* of the support element, and communicates with the front surface 1*a* of the support element by means of a hole 23 which is traversed by bolt 19. Hole 23 comprises two lateral arms inclined downwardly to allow for lateral and downward displacement of bolt 19 during release of the binding. Hole 23 is substantially shaped in the form of a bean. Head 21 of bolt 19 has an external hemispherical surface 24 which is supported by the bottom of housing 22 having the same configuration.

It is thus seen, from the description above, that the force of spring 15 of energization mechanism 5 which is supported on adjustable cap 17, is applied to transverse end wall 16 of bore 14 of body 3. In turn, end wall 16 is applied under pressure against front surface l*a* of support element 1 and more particularly on the three projections 7, 8 and 9 which define the two converging lines of support, $xx_1$ and $yy_1$. As a result of the reaction exerted, bolt 19 is biased frontwardly and hemispheric surface 24 of head 21 is pressed in the bottom end housing 22.

Support element 1 preferably has a protuberance 25 on its front surface 1*a* which is positioned between upper projections 7 and 8 and lower projection 9 and which thus projects frontwardly with respect to these projections. The end of housing 22, which receives head 21, is positioned in protuberance 25.

During lateral release, the assembly formed by pivoting body 3 and jaw 4 pivots around one of lateral support lines $xx_1$ or $yy_1$. By virtue of the lateral support lines on front surface 1*a* of support element 1 and their downward convergence, there results during lateral release and as a result of the pivoting of body 3 and jaw 4 leftwardly or rightwardly, a slight concomitant lifting of jaw 4, which compensates for parasitic friction of the sole of the boot against the ski. Thus, in FIG. 3 and if one assumes that the front of the boot is subjected to an excessive leftward torsional force applied to left wing 36 of the jaw tending to space the wing away from plane 31, then jaw 4 and body 3 pivot around lateral support line $xx_1$ along arrow $f_1$ and wing 36 lifts during pivoting, by virtue of the inclination of support line $xx_1$. During this movement the retention bolt 19 lowers slightly in the opposite (or right) lateral arm of hole 23, along arrow $f_1$ of FIG. 4. This movement is made possible by virtue of the particular "bean" configuration of hole 23.

Furthermore, by virtue of lateral support lines $xx_1$ and $yy_1$ on front surface 1*a* of the support element, and by virtue of the bias of cody 3 rearwardly by energization mechanism 5, the assembly of body 3 and jaw 4 can be displaced slightly frontwardly (in a straight line) against a return force exerted by spring 15 of energization mechanism 5.

In the case of a fall which is not exclusively torsional but also has a frontward component, the force that the front portion of sole 38 of boot 33 applies downwardly on upper surface 30 of the ski is increased. This is due to the tendency of the boot to pivot upwardly and frontwardly with respect to the ski during a frontward fall, despite the fact that the rear binding tends to oppose the lateral displacement (i.e., lateral release) of the front portion of the sole.

According tot he present invention, this tendency of the boot to pivot upwardly and frontwardly with respect to the ski during a fall has been put to beneficial use in those cases where a fall occurs with both a torsional and frontward component. In this case, the pivoting moment of jaw 4 and body 3 around axis $xx_1$ (which results from the force of the front end 37 of sole 38 of the boot on lateral wing 35 of jaw 4) or the pivoting moment of the jaw around axis $yy_1$ (which results from the action of the boot on lateral wing 36) is increased by an additional pivoting moment or torque exerting itself around the same axis and in the same direction as the lateral pivoting due to the torsional forces.

To accomplish this increase in the moment of the jaw, the embodiment illustrated in FIGS. 1–13, comprises a support zone 43 positioned between two lateral wings 35 and 36 and more precisely at substantially the same level as recesses 39 and 40 with respect to upper surface 3 of ski 2. Zone 43 a central means and faces the rear and is symmetrical with respect to plane 31 when the binding is at rest and in its rest position. Zone 43 is adapted to serve as a frontward support, for the front end zone 37 of sole 38 of boot 33. Zone 43 is positioned substantially the midpoint of contact (in the vertical direction) between zone 37 of boot 33 and jaw 4, and is higher than point A, the convergence point of the lines of support. Zone 43 may serve as a frontward support, substantially along plane 31, for the front of the boot.

Support zone 43 is fixed with respect to the two wings 35 and 36 when the binding is in use. However, means are preferably provided to adjust the position of wings 35 and 36 with respect to body 3 to permit the adapting of the relative positions of these two wings and of support zone 43 to any configuration and to all boot dimensions, so that contact between the front end zone of sole 38 of boot 33 with support zone 43 is assured as soon as the front end 37 is gripped laterally by recesses 39 and 40 of wings 35 and 36.

In addition, jaw 4 also comprises a surface 42 coated by a material having a low coefficient of friction preferably in the range of 0.01 to 0.25, such as polyethylene or polytetrafluorethylene. Surface 42 is positioned between jaw 4 and zone 43. In addition, zone 43 is, in the example illustrated in FIGS. 1–13 convex towards the rear, and defined by generatrices which are generally or substantially perpendicular to direction 32 and extend above point A.

Figure 13:
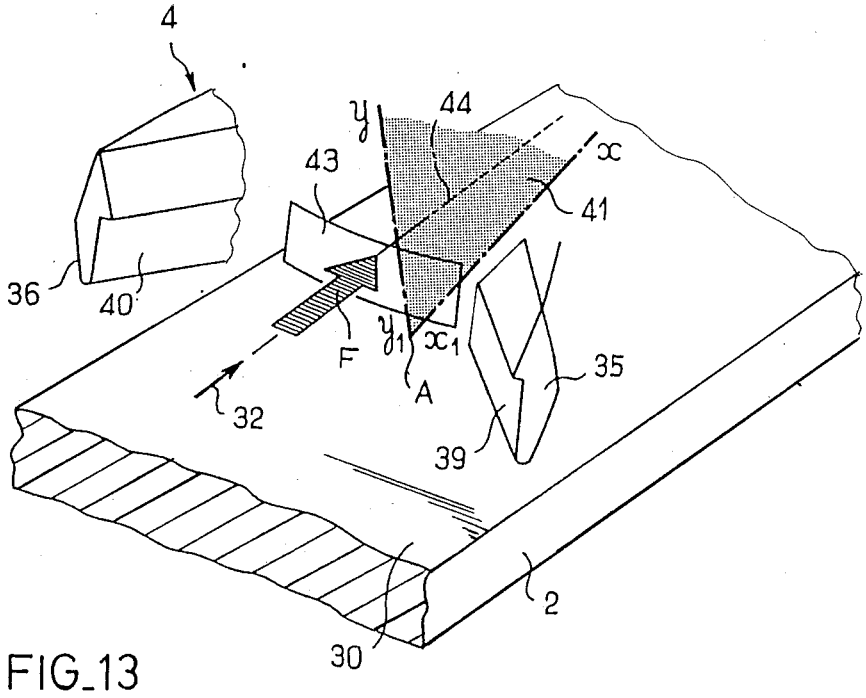
FIG. 13 schematically illustrates, in a perspective view from the rear to the front, the effect of a force which is applied frontwardly on the jaw of the binding.

Thus, when a fall occurs which results in a twisting or torsional action on the leg was well as a frontward force being exerted on the leg, this frontward force on the leg causes the front end zone of sole 38 of boot 33 to exert of a force on support zone 43, as seen in FIG. 13. Force F is generally oriented in direction 32 along plane 31, and acts along a force line 44 which intersects plane 41 of axes $xx_1$ and $yy_1$ between these axes, above point A. It should be noted that regardless of the axis ($xx_1$ or $yy_1$) around which the pivoting of jaw 4 and body 3 occurs with respect to support element 1, due to the torsional component of the fall, the force F thus applied along force line 44 acts an an additional torque for the pivoting of the binding in the same direction and around the same axis as the torsional component of the fall.

Figure 14:
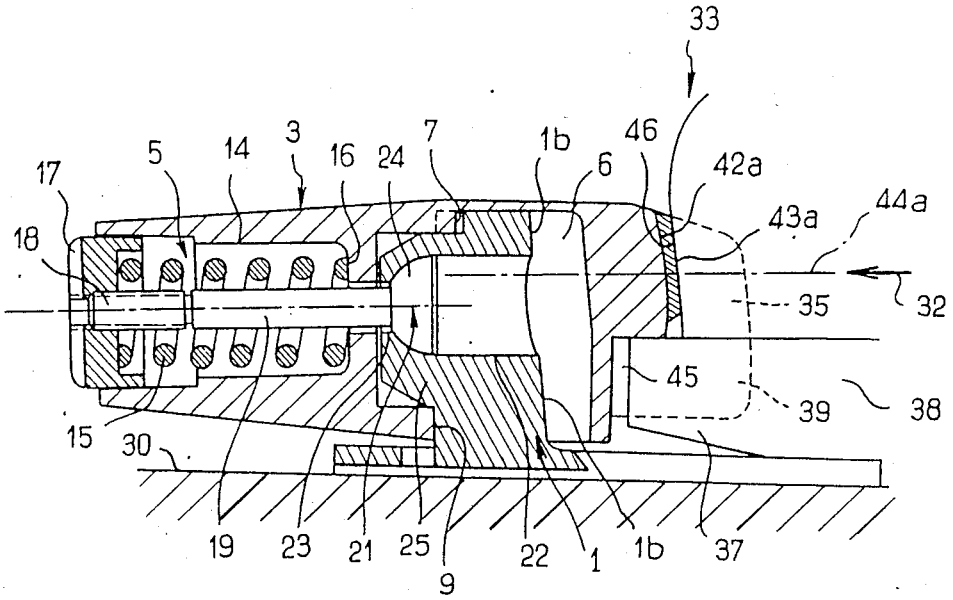
FIG. 14 is a view analogous to that of FIG. 1, and illustrates a second embodiment of a safety binding for a ski according to the present invention.

The embodiment illustrated in FIG. 14 differs from the embodiment shown in FIGS. 1–13 only with respect to the height at which the support zone, designated as 43 in the embodiment previously described, is situated on the jaw with respect to the ski.

Figure 2:
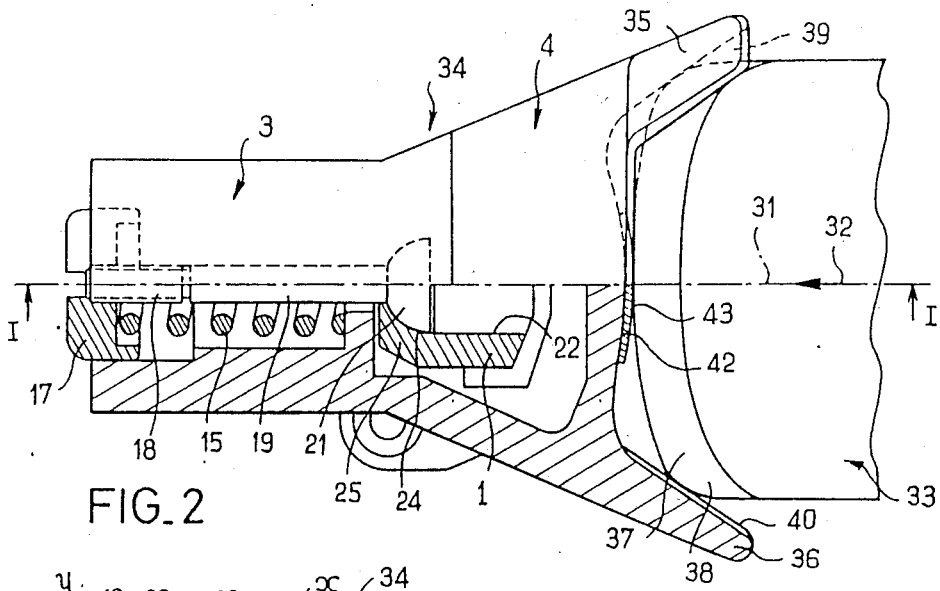
FIG. 2 is a view half in plane and half in horizontal cross sectional along plane II—II of FIG. 1.
Figure 3:
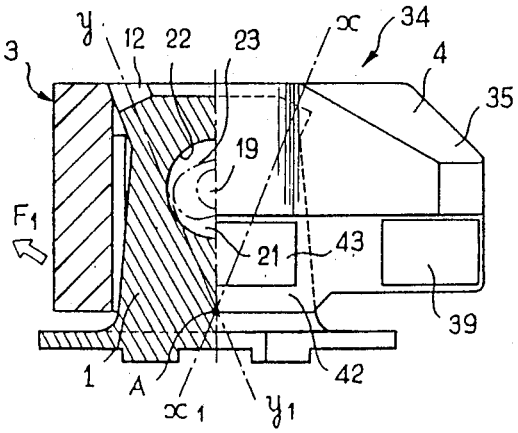
FIG. 3 is a view, half of which is a transverse cross sectional view along plane III—III of FIG. 1 and half of which is a front elevational view, taken from the right of FIG. 1, i.e., in a direction corresponding to the normal direction of displacement of the ski.

As a result, elements in FIG. 14 that are identical to the elements in FIG. 1 have the same reference numerals, with the following exceptions.

In this embodiment, support zone 43*a* replaces support zone 43 in FIGS. 1–13. The jaw also includes a coating on a rear surface 42*a* of jaw 4 between lateral wings 35 and 36 and over which support zone 43 is positioned. In addition, zone 43 is situated at a level which is higher than point A and higher than recesses 39 and 40 of wings 35 and 36 so as to serve as a frontward support, along a force line 44*l*, which intersects plane 41 of axes $xx_1$ and $yy_1$ between these two axes above point A. Support zone 43*a* no longer suppports a front end zone of sole 38 of boot 33, but supports a front end zone 46 of the upper of the boot. Jaw 4 also comprises a recess 45 beneath support zone 43*a* which opens rearwardly and downwardly to allow for the engagement of the front end zone 37 of sole 33 with the binding such that a contact is assured between front end zone 46 of the boot upper and support zone 43*a* as soon as the boot is placed in the binding.

Furthermore, support zone 43*a* is comparable to zone 43 in FIGS. 1–13 in that it is positioned symmetrically with respect to plane 31 when the binding is at rest and in its rest position, so that force line 44*l* is situated in plane 31, at least generally in direction 32 when the binding is at rest and when the boot begins to experience a force causing lateral release, just as is force line 44 in FIGS. 1–13.

The assembly of the binding is preferably symmetrical with respect to the plane of symmetry of the ski when the binding is in its rest position in which the longitudinal axis of the binding is parallel to plane 31.

In the particular embodiments which have been previously described by way of example, the two converging lateral support lines $xx_1$ and $yy_1$ are formed by two upper projections 7 and 8 and a lower projection 9 which cooperate with corresponding depressions 11, 12 and 13 provided on body 3. It is, however, within the scope of the invention to use a reverse arrangement, i.e., that support element 1 could comprise, instead of bumps 7, 8 and 9, corresponding openings while the body would comprise, opposite these depressions, projections, engaging these depressions.

The projections defining the lateral support lines can have any configuration, such as spherical, conical, cylindrical, cubic, etc.

According to an alternative embodiment, the converging lateral support lines $ss_1$ and $yy_1$ could be defined by the cooperation of two rebs having a V-shaped configuration provided on support element 1, or body 3, and which cooperate, respectively, with grooves having the same V-shaped configuration respectively provided on body 3 or support element 1. In these embodiments, point A could be positioned not only above the ski as in the examples illustrated in FIGS. 1–14, but could also be positioned therein or thereunder.

It should be noted that energization mechanism 5 comprises retention bolt 19 extending axially in the front portion of body 3. Hemispheric surface 24 of head 21 of bolt 19 is provided to form, in the end of housing opening 22, a universal joint allowing retention bolt 19 to follow the movements of body 3 both laterally and vertically during a release of the binding, leftwardly or rightwardly. Cap 17, which is screwed on threaded portion 18 of bolt 19, makes it possible to adjust the tension of spring 15 and consequently to adjust the release threshold or "hardness" of the binding.

It should be self-evident that the embodiment of FIGS. 18–20 can also be equipped with a front support 43 or 43*a* as previously defined.

In the embodiment of the invention which is illustrated in FIGS. 17–19, the elastic energization mechanism which presses body 203 and jaw 204 (which is integral with body 203) against anterior surface 201*a* of support element 201 is formed independently of body 203 on the exterior thereof. This elastic energization mechanism, designated in its entirety by reference 231, comprises a body 232 integral with a base plate 233 attached to the ski by means of screws 234. Base plate 233 also attaches support element 201 to ski 202. Body 232 is positioned slightly in front of support element 201 and is bored on both sides with a bore 235. The longitudinal axis of bore 235 is substantially parallel to the longitudinal axis of the ski. A piston 236 is slidably mounted in bore 235. Therefore, piston 236 is adapted to reciprocate along the longitudinal axis of bore 235 and ski 202. In addition, a piston 236 is adapted to contact the anterior transverse surface 203*a* of the anterior portion of pivoting body 203. Piston 236 is biased and pushed rearwardly onto surface 203*a* by a compression spring 237 positioned in bore 235. Spring 237 is supported on one end by an adjustment cap 238 screwed in threaded walls provided in the anterior portion of bore 235.

It is evident from the preceeding description that the pivoting assembly body 203 and jaw 204 is maintained and pressed against anterior surface 201*a* of support element 201 under the action of energization mechanism 231 as in the first embodiment. More specifically, the posterior side of the anterior portion of body 203 contacts anterior surface 201*a* of support element 201.

In the binding illustrated in FIGS. 17–19, the pivoting assembly 203 and 204 can be retained against vertical movement by engaging a projection 239, protruding from anterior transverse surface 203*a* of body 203, in a notch 240 provided in anterior surface 201*a* of support element 201. Projection 239 projects into cavity 206 when this occurs.

Although the invention has been described with reference to particular means, materials and embodiments, it is to be understood that the invention is not limited to the particulars disclosed and extends to all equivalents within the scope of the claims.

What is claimed is:

1. A ski binding adapted to releasably hold a front of a ski boot on a ski, wherein said front of said boot comprises a front end zone spaced from the lateral sides of said boot, wherein said binding comprises:

(a) a jaw adapted to hold said front of said boot and adapted to laterally pivot in response to lateral pivoting of said boot;

(b) a support on said ski, wherein said support comprises two downwardly converging lines of support, wherein said jaw is adapted to laterally pivot around either one of said downwardly converging lines of support; and (c) central support zone means on said jaw for transmitting frontward force exerted by said boot along a line offset from said lines of support to increase said moment experienced by said jaw in response to said boot experiencing a frontward force.

2. The binding defined by claim 1 in combination with a ski.

3. The binding defined by claim 1 wherein said boot has two lateral sides and wherein said jaw further comprises a rear portion and two lateral wings, each lateral wing adapted to grip one of said lateral sides of said boot, wherein said wings are positioned at said rear portion of said jaw.

4. The binding defined by claim 3 wherein said support zone means is positioned at said rear portion of said jaw and between said two wings, and wherein said support zone means is integral with said two wings.

5. The binding defined by claim 4 further comprising:
(d) an elastic energization mechanism adapted to press said jaw rearwardly against said support, wherein said elastic energization mechanism biases said jaw against lateral pivoting.

6. The binding defined by claim 5 wherein said support comprises a anterior portion and wherein said two downwardly converging lines of support are positioned on said anterior portion of said support, and wherein said jaw and said support together comprises means for lifting said jaw when said jaw laterally pivots around either one of said two downwardly converging lines of support.

7. The binding defined by claim 6 wherein said downwardly converging lines of support define a common transverse plane with respect to said ski, wherein said downwardly converging lines of support converge at a convergence point, and wherein said support zone means comprises means for supporting said front end zone of said boot along a line which intersects said transverse plane between said support lines and above said convergence point.

8. The binding defined by claim 7 wherein said jaw further comprises means for adjusting the relative positions of said lateral wings and said support zone means.

9. The binding defined by claim 7 wherein said two support lines are positioned symmetrically with respect to one another, and with respect to a longitudinal plane of symmetry of said ski, and wherein said support zone means is symmetrical with respect to said plane of symmetry when said binding is in a rest position in which the longitudinal axis of said jaw is substantially parallel to said plane of symmetry.

10. The binding defined by claim 9 wherein said two lines of support simultaneously contact said jaw when said binding is in said rest position.

11. The binding defined by claim 9 wherein said binding is symmetrical with respect to said plane of symmetry whern said jaw is supported by both lines of support on said support simultaneously.

12. The binding defined by claim 7 wherein said support zone means is positioned higher than said convergence point.

13. The binding defined by claim 7 wherein said boot further comprises a sole having a front end and a front end zone spaced from said lateral sides of said boot and wherein each lateral wing comprises a recess adapted to receive said front end of said sole therein.

14. The binding defined by claim 13 wherein said support zone means is positioned substantially at the same vertical level as said recesses, wherein said support zone means comprises means for supporting said front end zone of said sole of said boot.

15. The binding defined by claim 13 wherein said boot further comprises an upper having a front end zone, and wherein said support zone means is positioned higher than said recesses, wherein said support zone means comprises means for frontwardly supporting said front end zone of said upper.

16. The binding defined by claim 4 wherein said elastic means continuously maintains a portion of said jaw in contact with at least one of said lines of support.

17. The binding defined by claim 16 wherein said jaw comprises a cavity therein, adapted to receive said support, and wherein said jaw further comprises an anterior and posterior portion on opposite sides of said cavity.

18. The binding defined by claim 17 wherein said support comprises anterior and posterior portions and said jaw further comprises:
(i) means for holding said boot, positioned on said posterior portion of said jaw, wherein said posterior portion is said rear portion os said jaw; and
(ii) a surface on said anterior portion of said jaw, wherein said elastic means biases said surface against said anterior portion of said support.

19. The binding defined by claim 18 wherein said anterior portion of said support comprises:
(i) first and second projections positioned symmetrically with respect to the vertical and longitudinal plane of symmetry of said binding; and
(ii) a third projection, space below said first and second projections and positioned in said vertical and longitudinal plane of symmetry of said binding, and wherein said surface on said anterior portion of said jaw comprises:
(i) first and second grooves, adapted to engage said first and second projections, respectively, and
(ii) a third groove, adapted to engage said third projection, wherein said projections comprises said two lines of support.

20. The binding defined by claim 19 wherein said first and third projection comprises one of said lines of support, and wherein said second and third projection comprise the other line of support.

21. The binding defined by claim 19 wherein said first and second projections are laterally spaced apart and are at substantially the same vertical height.

22. The binding defined by claim 19 wherein said projections are in the same transverse plane.

23. The binding defined by claim 18 wherein said anterior portion of said support comprises:
(i) a first and second groove, positioned symmetrically with respect to the vertical and longitudinal plane of symmetry of said binding; and
(ii) a third groove, spaced below said first and second grooves and positioned in the vertical and longitudinal plane of symmetry of said binding, and wherein said surface on said anterior portion of said jaw comprises:
(i) first and second projections, adapted to engage said first and second grooves, respectively; and
(ii) a third projection, adapted to engage said third groove, wherein said grooves comprise said two lines of support.

24. The binding defined by claim 23 wherein said first and third groove comprises one of said lines of support, and wherein said second and third grooves comprise the other line of support.

25. The binding defined by claim 18 wherein said anterior portion of said support comprises two elements, having a V-shaped configuration, wherein said two elements are positioned symmetrically with respect to the vertical and longitudinal plane of symmetry of said binding, and wherein said surface on the anterior portion of said jaw comprises two complementary elements, having a V-shaped configuration and adapted to engage said two elements on said anterior portion of said support, wherein said two V-shaped elements on said support comprise said two lines of support.

26. The binding defined by claim 25 wherein said two elements on said support are projections and said two elements on said jaw comprise grooves.

27. The binding defined by claim 18 wherein said two elements on said support are grooves, and said two elements on said jaw comprise projections.

28. The binding defined by claim 17 wherein said jaw comprises an anterior portion having an axial bore therein and said elastic means comprises a compression spring positioned in said axial bore.

29. The binding defined by claim 28 wherein said support comprises an anterior portion, and said jaw further comprises a wall having first and second sides, said first side comprising one end of said axial bore, and wherein said second side is adjacent said anterior portion of said support, and wherein one end of said spring contacts said first side of said wall.

30. The binding defined by claim 29 wherein said anterior portion of said jaw further comprises a cap at the opposite end of said bore from said wall, and wherein the other end of said spring contacts said cap, and wherein said cap comprises means for adjusting the tension in said spring.

31. The binding defined by claim 30 wherein said cap is threaded and said jaw further comprises a shaft, positioned in said axial bore and having a threaded end adapted to receive said threaded cap thereon.

32. The binding defined by claim 31 wherein said support further comprises a posterior portion, and an opening therein, extending fromsaid posterior to said anterior portion, and wherein said shaft further comprises an expanded head, at the other end thereof, adapted to engage said opening of said support.

33. The binding defined by claim 32 wherein said opening is formed axially and horizontally in said support element.

34. The binding defined by claim 33 wherein said opening has a first end adjacent said anterior portion, and said expanded head and said first end of said opening adjacent said anterior portion both have a substantially hemispherical shape.

35. The binding defined by claim 32 wherein said jaw is adapted to be displaced viertically and wherein said expanded head and said opening comprise means for permitting said shaft to follow the vertical and lateral movement of said jaw.

36. The binding defined by claim 32 wherein a portion of said opening adjacent said anterior surface of said support is substantially bean-shaped.

37. The binding defined by claim 32 wherein a portion of said opening adjacent said anterior surface of said support has two downwardly inclined lateral arms.

38. The binding defined by claim 1 further comprising a surface between said jaw and said support zone means, having a coefficient of friction between 0.01 and 0.25.

39. The binding defined by claim 38 wherein said surface comprises a material selected from the group consisting of polyethylene and polytetrafluorethylene.

40. The binding defined by claim 1 wherein said support comprises an anterior side, wherein said lines of support are on said anterior side of said support.

41. A ski binding adapted to releasably hold a front of a ski boot on a ski, wherein said front of said boot comprises a front end zone spaced from the lateral sides of said boot, wherein said binding comprises:

(a) a jaw adapted to hold said front of said boot and adapted to laterally pivot in response to lateral pivoting of said boot, wherein said jaw experiences a moment in response to lateral pressure from said boot against said jaw;

(b) a support on said ski, wherein said support comprises two downwardly converging lines of support, wherein said jaw is adapted to laterally pivot around either one of said downwardly converging lines of support;

(c) elastic means for elastically biasing said jaw against lateral pivoting; and (d) central support zone means on said jaw for transmitting frontward force exerted by said boot along a line offset from said lines of support to increase said moment experienced by said jaw in response to said boot experiencing a frontward force without changing the bias of said elastic means.

42. The binding defined by claim 41 wherein said central support zone means increases said moment in response to a frontward fall.

43. The binding defined by claim 41 in combination with a ski.

44. The binding defined by claim 41 wherein said jaw further comprises a rear portion and two lateral wings, each lateral wing adapted to grip one of said lateral sides of said boot, wherein said wings are positioned at said rear portion of said jaw.

45. A ski binding adapted to releasably hold a front of a ski boot on a ski, wherein said front of said boot comprises a front end zone spaced from the lateral sides of said boot, wherein said binding comprises:

(a) a jaw adapted to hold said front of said boot and adapted to laterally pivot in response to lateral pivoting of said boot, wherein said jaw experiences a moment in response to lateral pressure from said boot against said jaw;

(b) a support on said ski, wherein said support comprises two downwardly converging lines of support, wherein said jaw is adapted to laterally pivot around either one of said downwardly converging lines of support; and (c) central support zone means on said jaw for transmitting frontward force exerted by said boot along a line offset from said lines of support to increase said moment experience by said jaw in response to said boot experiencing a frontward force wherein said jaw further comprises a rear portion and two lateral wings, each lateral wing adapted to grip one of said lateral sides of said boot, wherein said wings are positioned at said rear portion of said jaw, wherein said means is positioned at said rear portion of said jaw and between said two wings, and wherein said means is integral with said two wings.

46. The binding defined by claim 45 further comprising:

(d) an elastic energization mechanism adapted to press said jaw rearwardly against said support, wherein said elstic energization mechanism biases said jaw against lateral pivoting.

47. The binding defined by claim 46 wherein said support comprises a rear portion and wherein said two downwardly converging lines of support are positioned on said rear portion of said support, and wherein said jaw and said support together comprises means for lifting said jaw when said jaw laterally pivots around either one of said two downwardly converging lines of support.

48. The binding defined by claim 47 wherein said downwardly converging lines of support define a common transverse plane with respect to said ski, wherein said downwardly converging lines of support converge at a convergence point, and wherein said means comprises means for supporting said front end zone of said boot along a line which intersects said transverse plane between said support lines and above convergence point.

49. The binding defined by claim 48 wherein said means is positioned higher than said convergence point.

50. The binding defined by claim 48 wherein said boot further comprises a sole having a front end and a front end zone spaced from said lateral sides of said boot, and wherein each lateral wing comprises a recess adapted to receive said front end of said sole therein.

51. The binding defined by claim 50 wherein said support zone means is positioned substantially at the same vertical level as said recesses, wherein said support zone comprises means for supporting said front end zone of said sole of said boot.

52. The binding defined by claim 50 wherein said boot further comprises an upper having a front end zone, and wherein said means is positioned higher than said recesses, wherein said means comprises means for frontwardly supporting said front end zone of said upper.

53. The binding defined by claim 48 wherein said jaw further comprises means for adjusting the relative positions of said lateral wings and said support zone means.

54. The binding defined by claim 48 wherein said two suport lines are positioned symmetrically with respect to one another, and with respect to a longitudinal plane of symmetry of said ski, and wherein said means is symmetrical with respect to said plane of symmetry when said binding is in a rest position in which the longitudinal axis of said jaw is substantially parallel to said plane of symmetry.

55. The binding defined by claim 54 wherein said two lines of support contact said jaw when said binding is in said rest position.

56. The binding defined by claim 54 wherein said binding is symmetrical with respect to said plane of symmetry when said jaw is supported by both lines of support on said support simultaneously.

57. A ski binding adapted to releasably hold the front of a ski boot on a ski, wherein said front of said boot comprises a front end zone spaced from the lateral edges of said boot, wherein said binding comprises:

(a) a jaw adapted to hold said front of said boot and adapted to laterally pivot in response to pivoting of said boot, wherein said jaw experiences a moment in response to lateral pressure from said boot on said jaw;

(b) a support on said ski, wherein said support comprises two downwardly converging lines of support, wherein said jaw is adapted to laterally pivot around either one of said downwardly converging lines of suppport; and (c) a central support zone means on said jaw for supporting said front end zone of said boot when said front of said boot is held by said jaw and for transmitting frontward force exerted by said boot along a line offset from said lines of support, wherein said lines of support converge at a convergence point, wherein said support zone means is positioned above said convergence point whereby said moment experienced by said jaw is increased in response to forward pressure of said front end zone of said boot on said support zone means.

58. The binding defined by claim 57 wherein each portion of said jaw maintains substantially the same distance from one of said two downwardly converging lines of support during lateral pivoting of said jaw around either one of said two downwardly converging lines of support.

* * * * *

UNITED STATES PATENT AND TRADEMARK OFFICE

CERTIFICATE OF CORRECTION

PATENT NO. : 4,699,396

DATED : October 13, 1987

INVENTOR(S) : Jean-Pierre DIMIER et al.

It is certified that error appears in the above-identified patent and that said Letters Patent is hereby corrected as shown below:

At column 2, line 57, change "zones" to ---zone---.

At column 2, line 68, delete "is" before "so".

At column 3, line 20, delete "is" after "binding".

At column 5, line 9, change "ofthe" to ---of the---.

At column 5, line 10, change "ths" to ---this---.

At column 18, line 54, change "elstic" to ---elastic---.

At column 7, line 39, delete "and" before "wings".

At column 7, line 64, change "allow" to ---alloy---.

At column 8, line 6, change "of body of body" to ---of body---.

At column 8, line 10, change "illustrates" to ---illustrate---.

At column 8, line 67, change "is" to ---are---.

At column 9, line 2, change "bore" to ---bores---.

At column 9, line 3, change "an end zone" to ---end zones---.

At column 10, line 66, change "bott" to ---bolt---.

At column 11, line 50, change "cody" to ---body---.

At column 11, line 64, change "tot he" to ---to the---.

UNITED STATES PATENT AND TRADEMARK OFFICE

CERTIFICATE OF CORRECTION

PATENT NO. : 4,699,396

DATED : October 13, 1987

INVENTOR(S) : Jean-Pierre DIMIER et al.

It is certified that error appears in the above-identified patent and that said Letters Patent is hereby corrected as shown below:

At column 12, line 44, change "was" to ---as---.

At column 12, line 47, delete "of" before "a".

At column 12, line 55, change "an an" to ---as an---.

At column 15, line 9, change "a" to ---an--- before "anterior".

At column 15, line 42, change "whern" to ---when---.

At column 16, line 8, change "os" to ---of---.

At column 17, line 27, change "fromsaid" to ---from said---.

At column 17, line 40, change "viectically" to ---vertically---.

Signed and Sealed this

Twenty-fourth Day of July, 1990

*Attest:*

HARRY F. MANBECK, JR.

*Attesting Officer*

*Commissioner of Patents and Trademarks*